US005421414A

United States Patent [19]

Lane et al.

[11] Patent Number: 5,421,414

[45] Date of Patent: Jun. 6, 1995

[54] SIPHON STRING ASSEMBLY COMPATIBLE FOR USE WITH SUBSURFACE SAFETY DEVICES WITHIN A WELLBORE

[75] Inventors: Andrew R. Lane; Rufus Mullins, Jr.; Ronald C. Sadlin, all of Houston; Colby M. Ross, Carrollton, all of Tex.

[73] Assignee: Halliburton Company, Houston, Tex.

[21] Appl. No.: 104,374

[22] Filed: Aug. 9, 1993

[51] Int. Cl.[6] ..... E21B 23/00

[52] U.S. Cl. ..... 166/382; 166/384; 166/88; 166/212

[58] Field of Search ..... 166/88, 212, 375, 382, 166/384

[56] References Cited

U.S. PATENT DOCUMENTS

| | | | |
|---|---|---|---|
| 4,051,894 | 10/1977 | Goad | 166/73 |
| 4,059,150 | 11/1977 | Manderscheid | 166/120 |
| 4,078,606 | 3/1978 | Montgomery | 166/120 |
| 4,151,881 | 5/1979 | Armstrong | 166/318 |
| 4,420,042 | 12/1983 | Tunstall | 166/297 |
| 4,509,599 | 4/1985 | Chenoweth et al. | 166/370 |
| 4,681,159 | 7/1987 | Allwin et al. | 166/124 |
| 4,832,129 | 5/1989 | Sproul et al. | 166/387 |
| 4,844,516 | 7/1989 | Baker | 285/175 X |
| 4,986,362 | 1/1991 | Pleasants | 166/382 |
| 4,993,493 | 2/1991 | Arnold | 166/382 |
| 5,029,642 | 7/1991 | Crawford | 166/237 X |
| 5,038,860 | 8/1991 | Baugh et al. | 166/382 X |
| 5,040,598 | 8/1991 | Pleasants | 166/98 |
| 5,086,845 | 2/1992 | Baugh | 166/382 |
| 5,090,481 | 2/1992 | Pleasants et al. | 166/384 X |
| 5,092,400 | 3/1992 | Jagert | 166/88 |
| 5,113,939 | 5/1992 | Ross et al. | 166/120 |
| 5,146,984 | 9/1992 | Pleasants | 166/382 X |

*Primary Examiner*—Roger J. Schoeppel

*Attorney, Agent, or Firm*—Tracy W. Druce; Warren B. Kice

[57] ABSTRACT

A hanger assembly used to support tubing, such as a siphon string, and other tools beneath the surface of a wellbore within casing or production tubing. The assembly includes a setting mechanism having first and second sleeves responsive to increased pressure for moving relative to one another for activating a slip assembly and sealing element. The setting mechanism is connected to reeled tubing by a quick disconnect device defining a passage for permitting fluid flow from the surface of the wellbore to the setting mechanism to provide hydraulic activation. The disconnect device is responsive to increased pressure within the passage for disconnecting the reeled tubing from the setting mechanism.

12 Claims, 3 Drawing Sheets

SIPHON STRING ASSEMBLY COMPATIBLE FOR USE WITH SUBSURFACE SAFETY DEVICES WITHIN A WELLBORE

FIELD OF THE INVENTION

The present invention relates to hanger assemblies for use with oil and gas wells, and in particular, to a hanger assembly which is set beneath the wellhead within the production tubing or casing for supporting a siphon string in the well.

BACKGROUND OF THE INVENTION

Hanger assemblies are used to insert and support strings of tubing within downhole wellbores and are typically structurally incorporated with the wellhead. Therefore, before an additional string of tubing can be inserted into an existing wellbore, the wellhead must first be modified to include an additional bowl for receiving the new hanger assembly. This often also requires changing out the valves and possibly the entire wellhead, and is thus expensive and time consuming.

An additional problem results when a subsurface safety device has been inserted into the wellbore to prevent uncontrolled flow. Hanging an additional string of tubing through such a safety device renders it unoperable, and would place offshore wells in noncompliance with government safety regulations.

One particular instance in which the above problems are experienced is when hanging a siphon string to extend the flowing productive life of a well. A siphon string is a reduced diameter string of tubing used to effectively reduce the diameter of the production tubing. When installed in the wellbore, the velocity of the oil and gas travelling up the tubing is increased due to the reduced flow area, thereby enabling additional oil and gas to be produced under the well's natural pressure prior to the expense of installing artificial lift systems.

However, the cost of working over the well and/or modifying the wellhead to install the siphon string hanger assembly is relatively high when compared to the expected amount of additional recovery. In addition, siphon strings presently cannot be used in offshore wells due to their interference with the required subsurface safety devices.

Therefore, there is a need for an inexpensive and simple device for hanging tubing below the wellhead within the casing or production tubing which does not require modification of the wellhead and does not interfere with the operation of subsurface safety devices.

SUMMARY OF THE INVENTION

It is therefore an object of the present invention to provide an assembly for hanging strings of tubing and tools within a wellbore beneath the wellhead.

It is a further object of the present invention to provide an assembly for hanging strings of tubing and tools within a wellbore without having to modify the existing wellhead.

It is a still further object of the present invention to provide an assembly for hanging strings of tubing and tools within a wellbore without interfering with the operation of subsurface safety devices associated with the wellhead.

It is a still further object of the present invention to provide such a hanger assembly which is hydraulically activated.

It is a still further object of the present invention to provide such a hanger assembly which can be set and retrieved by reeled tubing.

The foregoing problems are solved and the foregoing objects and a technical advance is achieved by the method and apparatus of the present invention for hydraulically hanging a string of tubing within a wellbore beneath the wellhead. In a departure from the art, the hanger assembly of the present invention enables siphon strings, as well as other tubing and tools, to be installed and secured in place within the wellbore beneath the wellhead, without having to modify the existing wellhead.

The hanger assembly of the present invention comprises a mandrel and a tubular cylinder which receives a tubular piston to hydraulically activate a slip assembly and sealing element to set the hanger assembly within casing or production tubing. The hanger assembly is inserted into the wellbore by reeled tubing and is connected to the reeled tubing by a quick disconnect device enabling the reeled tubing to be removed after the hanger assembly is set. The quick disconnect device includes an upwardly extending fishneck which is easily engagable to remove the hanger assembly from the wellbore when desired.

The hanger assembly of the present invention can be used in combination with a siphon string which is threadably engaged with the lower end of the hanger assembly which is used to prolong the natural production from a well.

BRIEF DESCRIPTION OF THE DRAWINGS

The present invention may be better understood, and its numerous objects, features and advantages will become apparent to those skilled in the art, by reference to the accompanying drawings in which.

DESCRIPTION OF THE PREFERRED EMBODIMENT

Figure 1:
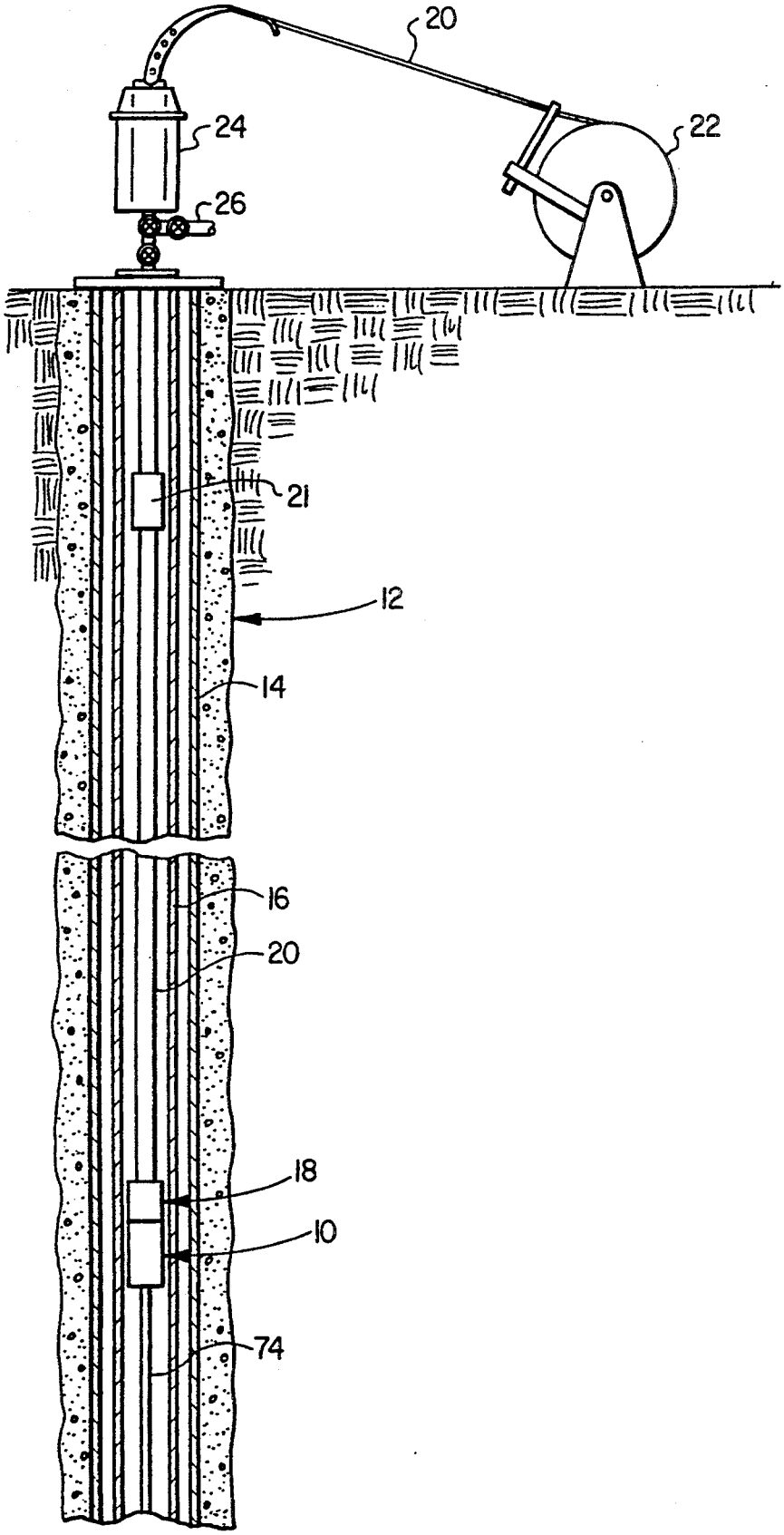
FIG. 1 is a schematic view, partially in elevation and section, and partially broken away, of an oil or gas well showing the assembly of the present invention as it is being installed in a wellbore.

Referring to FIG. 1 of the drawings, the reference numeral 10 schematically refers to the subsurface hanger assembly of the present invention disposed in an oil or gas well 12. A casing 14 is cemented in the well 12 and a string of tubing 16, such as production tubing, is anchored in the casing 14 by a plurality of packers (not shown) which seal off the annular space between the casing 14 and the production tubing 16.

The hanger assembly 10 is connected by a connector 18, described below, to the end of a string of reeled tubing 20. A safety valve 21 is connected in the string and extends above the connector 18 and the hanger assembly 10. The safety valve 21 is shown and described in detail in U.S. Pat. No. 5,285,850 that is assigned to the assignee of the present invention. It is understood that additional components (not shown) such as centralizers, knuckle joints and accelerators could also be connected in the string of reeled tubing 20 to provide their various functions.

The reeled tubing 20 is stored on an above ground reel 22, and is injected coaxially into the production tubing 16 by an injector 24. It is understood that a manifold (not shown) is provided which includes the necessary pumps, valves and fluid reservoirs to discharge high pressure fluid into and through the reeled tubing 20 for purposes to be described. A wellhead valve system 26 is located between the ground surface and the injector 24 and is used to control vertical access to, and fluid communication with, the upper section of the production tubing 16. It is understood that blowout preventers, or the like (not shown), can be installed to block fluid flow during emergency conditions.

Figure 2A:
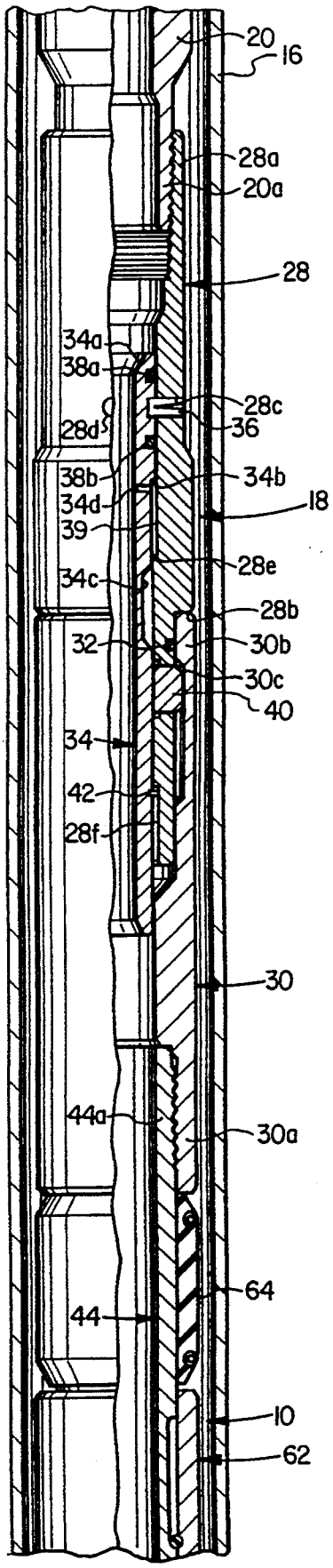
FIGS. 2A–2B are enlarged longitudinal sectional views of the assembly of the present invention prior to being set within a wellbore with FIG. 2B being a downward continuation of FIG. 2A.
Figure 2B:
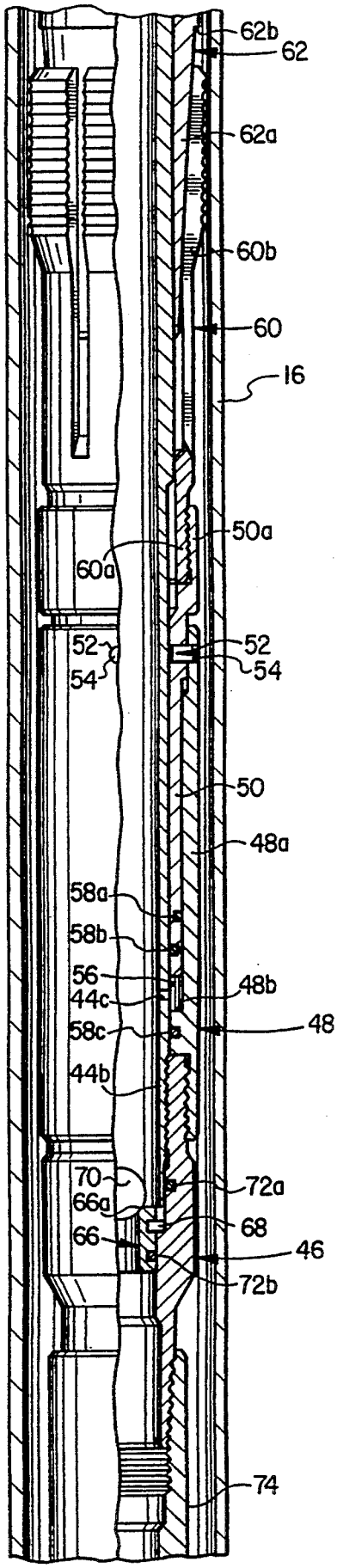

As more particularly shown in FIGS. 2A–2B, the reeled tubing 20 extends coaxially within the production tubing 16 and is connected to the hanger assembly 10 by the connector 18 which is in the form of a quick disconnect device, such as the emergency release device described in U.S. Pat. No. 5,146,984 which has been assigned to the assignee of the present invention and is hereby incorporated by reference.

The connector 18 (FIG. 2A) includes a sub 28 having an internally threaded end portion **28*a* for connecting to and receiving a corresponding externally threaded, reduced diameter end portion 20*a* of the reeled tubing 20, and a sub 30 coaxially aligned with the sub 28 and having an internally threaded end portion 30*a* for connecting to the hanger assembly 10. The sub 30 has a stepped inner diameter to form a fishneck 30*b* at its other end portion. The outer diameter of the sub 28 is stepped and defines a shoulder 28*b* which is engaged by the upper end of the fishneck 30*b* in the connected position of FIG. 2A, and a seal ring 32 is provided in an external groove in the sub 28 and normally engages the inner surface of the fishneck 30*b***.

A tubular prop 34 extends within the subs 28 and 30 and has an outer diameter slightly less than the inner diameters of the subs. The upper end of the prop 34 defines a seat surface **34*a* for receiving a ball 35 (FIG. 3A) which is dropped onto the seat surface through the reeled tubing 20 to activate the release mechanism of the connector 18, as will be described. The bore of the prop 34 connects the bore of the sub 28 to the bore of the sub 30 to define a continuous fluid flow passage for receiving fluid from the reeled tubing 20**.

Two sets of oppositely disposed, radially-extending openings **28*c* and 28*d* (only one of each being shown in the drawings) are formed through the sub 28. The set of openings 28*c* receive shear pins 36 which extend into appropriate grooves or notches in the prop 34 to secure the prop against axial movement relative to the subs 28 and 30. The shear pins 36 are adapted to shear under a predetermined shear force to break the connection between the prop 34 and the sub 28 to release the prop 34 for axial movement. The set of openings 28*d* function to equalize fluid pressure differentials across the sub 28, as will be described. The sets of openings 28*c* and 28*d* extend between two axially-spaced seal rings 38*a* and 38*b* disposed in external grooves in the prop 34** to seal against unwanted fluid flow.

The internal bore of the sub 28 and the outer corresponding surface of the prop 34 are stepped to form two spaced shoulders **28*e* and 34*b*, respectively, which define a cavity 39 therebetween, and an enlarged groove 34*c* is formed in the outer surface of the prop 34 in a downwardly spaced relation to the shoulder 34*b*. An axially-extending weep opening 34*d* extends through the prop 34 and, in the connected position of FIG. 2A, registers with the cavity 39 defined between the shoulders 28*e* and 34*b*** for reasons to be described.

A plurality of angularly-spaced retaining lugs 40, one of which is shown in FIG. 2A, extend through corresponding openings in the sub 28. One end of each of the lugs 40 extends flush with the bore of the sub 28 and is maintained in this position by engagement with the outer surface of the prop 34. The other end portion of each of the lugs 40 projects outwardly from its opening where it is engaged by an internal shoulder **30*c* formed on the fishneck 30*b* of the sub 30. Thus, the sub 30 and therefore the hanger assembly 10 are connected by means of the lugs 40 to the sub 28 and therefore to the reeled tubing 20 in a manner to prevent axial movement therebetween. A retaining ring 42 is disposed in an angular groove formed in the outer surface of the prop 34 and extends in a milled groove 28*f* formed in the inner surface of the sub 28 for reasons to be explained. The connector 18 further includes mechanical means which connect the sub 28 to the sub 30** to prevent any relative rotational movement between them while providing a means for the transfer of torque and allowing relative axial movement between the subs, such as the various means disclosed in U.S. Pat. No. 5,146,984, already incorporated herein.

The flow passage defined by the aligned bores of the subs 28 and 30 and the bore of the prop 34 receives fluid from the reeled tubing 20 and passes the fluid through the connector 18 to the hanger assembly 10 for actuating the hanger assembly 10, as will be described. The seal rings 32, **38*a* and 38*b* prevent fluid from escaping as it passes through the flow passage defined by the elements of the connector 18**.

The hanger assembly 10 of the present invention is shown in its run-in condition in FIGS. 2A and 2B and comprises a mandrel 44 having an externally threaded upper end portion **44*a* for connecting to the threaded end portion 30*a* of the sub 30 of the connector 18, and an externally threaded lower end portion 44*b* for connecting to and receiving a corresponding internally threaded end of a mandrel extension 46. The upper end of the mandrel extension 46 is also externally threaded for connecting to the lower end of a cylinder 48 extending circumferentially around a lower portion of the mandrel 44. The cylinder 48 has an extended, stepped inner diameter portion 48*a* forming a shoulder 48*b* and defines with the mandrel 44 an annular space for receiving a tubular piston 50 having an internally threaded upper end 50*a* and disposed for axial movement relative to the mandrel 44 and the cylinder 48**.

A plurality of radially-extending openings 52, two of which are shown in FIG. 2B, are formed through the cylinder 48 and the piston 50, and are spaced at predetermined intervals such as 90 degrees. Each of the openings 52 receives a shear pin 54 to secure the piston 50 against axial movement relative to the mandrel 44 and the cylinder 48, it being understood that the shear pins 54 are adapted to shear under a predetermined shear force to allow the piston 50 to move relative to the mandrel 44 and the cylinder 48.

The lower end of the piston 50 is spaced from the shoulder **48*b* of the cylinder 48 and defines an annular cavity 56. An axially-extending weep opening 44*c* extends through the mandrel 44 and registers with the cavity 56 for supplying fluid to the cavity 56 from the internal bore of the mandrel 44. A seal ring 58***a* extends between the corresponding surfaces of the cylinder 48 and the piston 50, and two axially spaced seal rings 58*b* and 58*c* extend between corresponding surfaces of the piston 50, the cylinder 48, and the mandrel 44 to prevent fluid from flowing from the cavity 56 into the space between the latter surfaces.

A tubular slip assembly 60 having an externally threaded end 60*a* is connected to the internally threaded upper end 50*a* of the piston 50. The slip assembly 60 has a plurality of upwardly extending fingers 60*b* with teeth for engaging the inner wall of the production tubing 16. Each of the fingers 60*b* rests upon a sloped portion 62*a* of a wedge 62 encircling a portion of the mandrel 44. The outer surface of the wedge 62 is stepped at the upper end of the sloped portion 62*a* to define a shoulder 62*b* for engagement with the upper end of the fingers 60*b* of the slip assembly 60. A sealing element 64 (FIG. 2A) of a resilient material surrounds a portion of the mandrel 44 and is confined between the sub 30 and the wedge 62.

Referring back to FIG. 2B, a ring seat 66 is disposed in the bore of the mandrel extension 46 and is connected thereto by a plurality of radially spaced shear pins 68 (only one of which is shown in the drawings) which respectively extend through radially spaced openings formed in the ring seat 66 and the mandrel extension 46. The upper end of the ring seat 66 is formed with a seat surface 66*a* to define a seat for a ball 70 which is smaller in size than the ball 35 and the inside diameter of the prop 34. Thus the ball 70 may be dropped onto the seat surface 66*a* through the reeled tubing 20 and the connector 18 to seal the bore of the mandrel extension 46 to set the hanger assembly 10 within the production tubing 16 as will be described. The shear pins 68 are adapted to shear under a predetermined shear force to release the ring seat for axial movement. The shear pins 68 are disposed above a seal ring 72*a* in the ring seat 66 and an additional seal ring 72*b* which extends between the corresponding surfaces of the mandrel extension 46 and the mandrel 44, to prevent the escape of fluids from within the bore of the mandrel extension 46.

Extending downwardly from the mandrel extension 46 is a siphon string 74 for prolonging the natural production from the well 12. The siphon string 74 is sized to extend down the production tubing 16 to the oil or gas formation being produced and has a diameter less than that of said well so that it can function in a conventional manner to siphon production fluids from the well. An expendable plug (not shown) can be inserted into the lower end of the siphon string 74 to prevent well fluids from entering the string until after it has been hung within the wellbore as described below.

In operation, the safety valve 21 is connected in the string of reeled tubing 20 and the connector 18 is connected to the end of the reeled tubing 20. The hanger assembly 10, including the siphon string 74, is connected to the lower end of the connector 18 and the assembly thus formed is inserted into the production tubing 16. The hanger assembly 10 is lowered and/or pushed to a desired position in the tubing 16 by the injector 24, and the well 12 may be reverse circulated to ensure that it is unloaded.

When the hanger assembly 10 reaches the desired position in the production tubing 16, the ball 70 is dropped through the reeled tubing 20 and passes through the connector 18 and the hanger assembly 10 until it rests on the ring seat 66. A fluid, such as nitrogen, is then introduced into the reeled tubing 20 and passes through the opened safety valve 21 and to the bore of the hanger assembly 10. The fluid pressure within the latter bore increases due to the seal formed by the ball 70. Thus, fluid pressure builds up in the cavity 56 via the weep opening 44*c* thus exerting oppositely directed forces against the piston 50 and the cylinder 48, respectively.

Figure 3A:
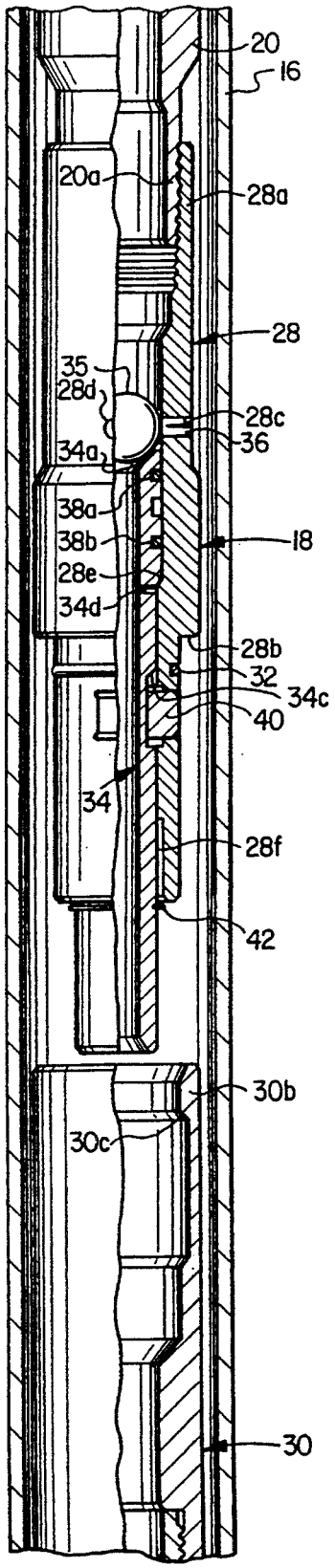
FIGS. 3A–3C are enlarged longitudinal sectional views of the assembly of the present invention after being set within a wellbore with FIG. 3B being a downward continuation of FIG. 3A, and FIG. 3C being a downward continuation of FIG. 3B.
Figure 3B:
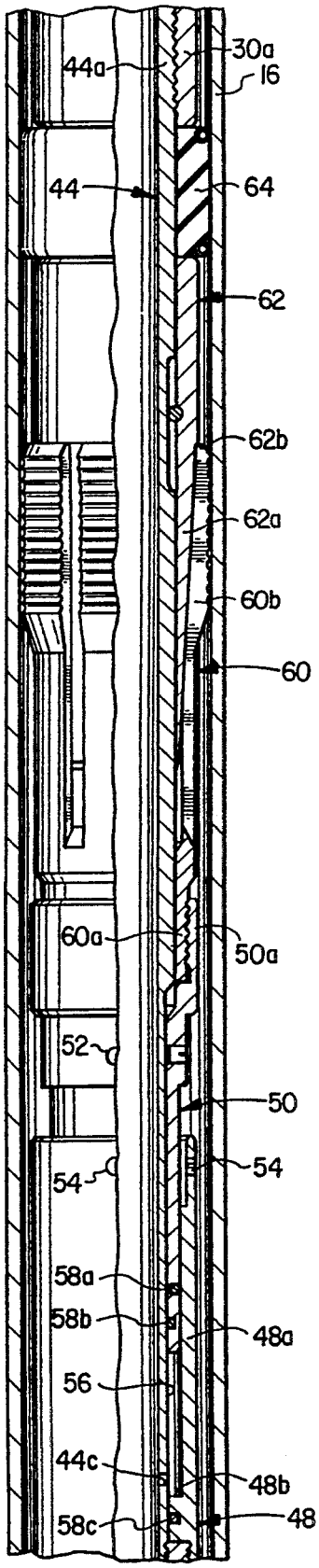
Figure 3C:
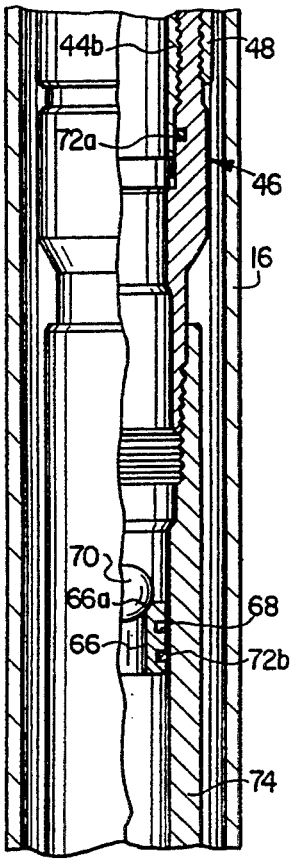

When the pressure in the cavity 56 exceeds the predetermined shear force needed to shear the shear pins 54, the piston 50 is forced upwardly with respect to the mandrel 44, thereby urging the fingers 60*b* of the slip assembly 60 relative to the sloped portion 62*a* of the wedge 62, while at the same time compressing the sealing element 64 between the wedge 62 and the sub 30 as shown in FIGS. 3A–3C. Upward movement of the fingers 60*b* relative to the wedge 62 continues until the fingers engage the shoulder 62*b* of the wedge 62. Such relative movement causes the sloped portion 62*a* to urge the fingers 60*b* outwardly until they engage the inner surface of the production tubing 16, thereby locking the hanger assembly 10 in place. At the same time, due to the compression of the sealing element 64, the sealing element expands radially outwardly against the inner wall of the production tubing 16, thereby sealing against the passage of fluid upwardly through the production tubing 16 and forcing the flow through the siphon string 74. The hanger assembly 10 is thus locked, or set, in engagement with the production tubing 16 as shown in FIG. 3B.

Once the hanger assembly 10 is set, additional fluid is introduced, via the reeled tubing 20 to further increase the the fluid pressure to exert a sufficient downwardly-directed force against the ball 70 to shear the shear pins 68, thereby allowing the ring seat 66 and the ball 70 to be forced downwardly and discharged through the lower end of the siphon string 74. The ejection of the ring seat 66 will also eject any expendable plug in the lower end of the siphon string, creating a continuous, unrestricted bore from the siphon string 74, through the hanger assembly 10, into the production tubing 16 and up to the wellhead 26.

To start production through the siphon string 74, the ball 35 is dropped through the reeled tubing 20 until it comes to rest on the seat surface 34*a* of the prop 34 (FIG. 3A). A fluid, such as nitrogen, is again introduced into the reeled tubing 20 and builds up pressure within the reeled tubing 20 due to the seal now formed by the ball 35. The pressure is increased by the introduction of additional fluid to exert a sufficient downwardly-directed force against the ball 35, and thus the prop 34, to shear the shear pins 36 and drive the prop 34 downwardly relative to the sub 28.

When the shear pins 36 shear, the prop 34 moves downwardly relative to the subs 28 and 30 until the shoulder 34*b* of the prop 34 engages the shoulder 28*e* of the sub 28. Since the seal ring 38*a* moves past the set of openings 28*d*, the latter openings allow the fluid pressure within the reeled tubing 20 to equalize with the fluid pressure within the production tubing 16 which gives the reeled tubing operator an indication that the connector 18 has been activated. In this position, the groove 34*c* aligns with the lugs 40 which allows the lugs to move into the groove. The fishneck 30*b* is thus released from the lugs 40 and the sub 28 to move in an axial direction away from the sub 30, permitting a quick disconnect of the sub 28 from the hanger assembly 10. During this operation, the weep opening 34*d* permits any fluid trapped in the cavity 39 and in the groove 34*b* of the prop 34 to pass into the bore of the prop 34. Also, the retaining ring 42 limits movement of the prop 34 relative to the sub 28, thus preventing the lugs 40 from falling out of their respective openings in the sub 28. The sub 28, the prop 34 and the reeled tubing 20 can then be removed from the well 12, leaving the sub 30, including the exposed fishneck 30*b*, extending upwardly from the hanger assembly 10. Production from the well 12 can then be reinitiated through the siphon string 74, employing conventional methods.

The safety valve 21 functions in a conventional manner to selectively permit the flow of the actuation fluid downwardly through the reeled tubing 20 as described above, and to prevent the flow of production fluid upwardly through the reeled tubing 12.

When it is desired to remove the siphon string 74 from the wellbore, a pulling tool, or the like, is inserted into the production tubing 16 to engage the fishneck 30*b*. Then, upward pulling movement on the fishneck 30*b*, and therefore on the sub 30 and the mandrel 44, releases the slip assembly 60 and the sealing element 64 from their engagement with the inner surface of the production tubing 16, and thus permits removal of the remaining components, including the siphon string 74, from the wellbore.

It is thus seen that the hanger assembly 10 of the present invention can be used to hang strings of tubing and tools below the wellhead within the casing or production tubing without requiring any modification of the wellhead. Further, since the hanger assembly 10 can be set beneath the safety valve 21, it can be used to hang siphon strings or other equipment without interfering with the operation of the safety valve. Therefore, the present invention enables siphon strings to be employed in offshore wells, where currently their use is prohibited.

In addition, the hanger assembly 10 of the present invention can be run in a wellbore with reeled tubing, enabling it to be hydraulically activated. Moreover, it is easily retrievable from the wellbore after being set.

It is understood that the hanger assembly of the present invention is not limited to use with siphon strings but can be used to hang other strings and tool within the wellbore, in either the casing or other tubing. For example, the hanger assembly 10 could be used to isolate tubing holes in a single down hole trip, rather than using the conventional method of making multiple trips with wireline and a series of packers and spacer tubes.

Although a preferred embodiment of the present invention has been shown and described, a latitude of modification, change and substitution is intended in the foregoing disclosure, and in certain instances some features of the invention will be employed without a corresponding use of other features. Accordingly, it is appropriate that the appended claims be construed broadly and in a manner consistent with the scope of the invention.

What is claimed is:

1. A siphon string assembly compatible for use with a subsurface safety device within a wellbore, comprising:

a string of tubing extending in said wellbore and adapted to conduct fluid therein;

a subsurface safety device connected in said string of tubing for controlling fluid flow therethrough;

a hanger assembly set beneath said subsurface safety device in said string of tubing; and a siphon string connected to said hanger assembly.

2. The siphon string assembly compatible for use with a subsurface safety device within a wellbore as recited in claim 1, wherein said string of tubing is connected at an upper end of said tubing to a wellhead.

3. The siphon string assembly compatible for use with a subsurface safety device within a wellbore as recited in claim 1, wherein said subsurface safety device is a safety valve.

4. The siphon string assembly compatible for use with a subsurface safety device within a wellbore as recited in claim 1, wherein said siphon string has a reduced diameter from a diameter of said string of tubing thereby effectively reducing the diameter of said string of tubing for siphoning well fluids for passage upwardly through said hanger assembly and to the surface of said wellbore.

5. The siphon string assembly compatible for use with a subsurface safety device within a wellbore as recited in claim 1, wherein said siphon string is positioned below said hanger assembly when connected thereto and away from said subsurface safety device so that said siphon string does not extend through said subsurface safety device.

6. The siphon string assembly compatible for use with a subsurface safety device within a wellbore as recited in claim 1, wherein said hanger assembly further comprises:

means for securely engaging said wellbore to hang objects therein;

a connector releasably connected to said engaging means; and means connected between said connector and the surface of said wellbore for delivering fluid from the surface to said connector, said delivering means and said connector defining a passage for permitting fluid flow from the surface of said wellbore to said engaging means and said engaging means including means responsive to a predetermined pressure in said passage for activating said engaging means.

7. The siphon string assembly compatible for use with a subsurface safety device within a wellbore as recited in claim 6, wherein said engaging means further comprises a first sleeve, a shoulder extending inwardly from a bore of said first sleeve for receiving a ball to block fluid flow through said engaging means and increase the pressure therein.

8. The siphon string assembly compatible for use with a subsurface safety device within a wellbore as recited in claim 6, wherein said activating means further comprises:

a second sleeve extending adjacent said first sleeve and responsive to said increased pressure for moving relative to said first sleeve; and means responsive to said relative movement for moving outwardly toward said wellbore.

9. The siphon string assembly compatible for use with a subsurface safety device within a wellbore as recited in claim 8, wherein said outwardly moving means comprises a slip assembly having a plurality of teeth for engaging said wellbore.

10. The siphon string assembly compatible for use with a subsurface safety device within a wellbore as recited in claim 9, wherein said outwardly moving means further comprises a resilient material surrounding a portion of said engaging means for forming a seal with said wellbore.

11. The siphon string assembly compatible for use with a subsurface safety device within a wellbore as recited in claim 6, wherein said connector further comprises means responsive to a predetermined pressure within said passage for disconnecting and delivering means from said engaging means.

12. The siphon string assembly compatible for use with a subsurface safety device within a wellbore as recited in claim 6, wherein said delivering means comprising reeled tubing.

* * * * *